United States Patent [19]

Wood

[11] 4,187,944

[45] Feb. 12, 1980

[54] ARTICLE CARRIER AND BLANK THEREFOR

[75] Inventor: Prentice J. Wood, Hapeville, Ga.

[73] Assignee: The Mead Corporation, Dayton, Ohio

[21] Appl. No.: 21,456

[22] Filed: Mar. 19, 1979

[51] Int. Cl.[2] ..... B65D 5/48; B65D 75/00

[52] U.S. Cl. ..... 206/187; 229/28 BC

[58] Field of Search ..... 229/28 BC; 206/170, 206/174, 175, 184, 187, 190

[56] References Cited

U.S. PATENT DOCUMENTS

| | | | |
|---|---|---|---|
| 3,104,027 | 9/1963 | Kulig | 229/28 BC X |
| 3,402,872 | 9/1968 | Forrer | 229/28 BC |
| 3,567,069 | 3/1971 | Harrelson | 206/187 |
| 3,857,483 | 12/1974 | Wood | 206/188 X |
| 3,917,061 | 11/1975 | Stout | 206/187 |
| 4,010,847 | 3/1977 | Wood et al. | 206/187 |

*Primary Examiner*—Davis T. Moorhead

*Attorney, Agent, or Firm*—Walter M. Rodgers; Walter A. Rodgers

[57] ABSTRACT

An article carrier formed from a unitary blank comprises a bottom wall (21), side walls (1,12) foldably joined to the side edges of the bottom wall, end wall panels (4,6,13,14) foldably joined to the end edges of the side walls and extending inwardly therefrom, medial partition structure (8,9,17,19) foldably joined to the inner edges of the end wall panels and extending medially inward therefrom, handle structure (24,25) joined to the upper portion of the medial partition structure, two pairs of transverse partition panels (39-42, 51-54) disposed between the medial partition structure and the associated side wall on each side of the carrier, an anchoring tab (59,62,65,68) foldably joined to one of the transverse partition panels of each pair and secured to the inner surface of the associated side wall, one of the anchoring tabs on each side of the carrier being larger than the corresponding anchoring tab, and the inner one of the transverse partition panels of one pair being narrower than the corresponding transverse partition panel of the other pair.

10 Claims, 9 Drawing Figures

ARTICLE CARRIER AND BLANK THEREFOR

TECHNICAL FIELD

This invention relates to basket style article carriers which provide sufficient article separation and which can be easily and securely glued during formation of the carrier.

BACKGROUND ART

Article carriers are known in which a double thickness of paperboard material is provided between all critical points of article contact in order to comply with railroad shipping regulations. An example of this type of carrier is disclosed in U.S. Pat. No. 4,010,847, owned by the assignee of this invention, and U.S. Pat. No. 3,104,027. Since the various partitions in this general type of carrier are often formed in such a way as to cause voids of material in the collapsed carrier, some anchoring tabs are improperly glued because proper compression on these elements is virtually impossible to achieve.

DISCLOSURE OF INVENTION

A collapsed article carrier comprising handle structure with medial partition structure extending downwardly therefrom, a pair of end wall panels joined to the medial partition structure at each end of the carrier, a pair of side walls joined respectively to one of the end wall panels at each end of the carrier and disposed in overlapping relation with the medial partition structure, a bottom wall secured to the lower edges of the side walls, two pairs of overlapping transverse partition panels secured to the medial partition structure on each side thereof, an anchoring tab secured to one of each pair of transverse partition panels and to the corresponding side wall, and one of the transverse partition panels on each side of the carrier being disposed in overlapping relation with the corresponding anchoring tab.

BEST MODE FOR CARRYING OUT THE INVENTION

Figure 2:
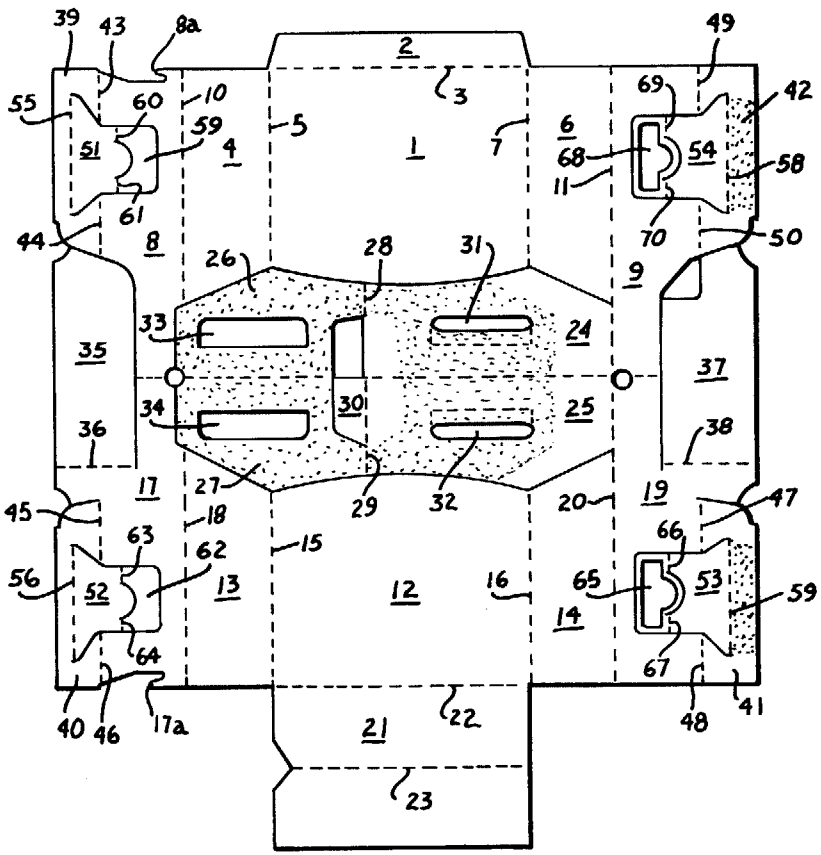
FIG. 2 is a plan view of a blank from which the carrier shown in FIG. 1 is formed.

In the drawings the numeral 1 designates a side wall of the carrier to the bottom edge of which a glue flap 2 is foldably joined along fold line 3. End wall panel 4 is foldably joined to an end edge of side wall 1 along fold line 5 while end wall panel 6 is foldably joined to the opposite end edge of side wall 1 along fold line 7. Medial panels 8 and 9 are foldably joined to end wall panels 4 and 6 respectively along fold lines 10 and 11. Medial panel 8 is provided with locking notch 8*a*.

The other side of the blank is similar to that just described and includes side wall 12 to the side edges of which end wall panels 13 and 14 are foldably joined respectively along fold lines 15 and 16. Medial panel 17 is foldably joined to end wall panel 13 along fold line 18 and medial panel 19 is foldably joined to end wall panel 14 along fold line 20. Medial panel 17 is provided with locking notch 17*a*. Also bottom wall 21 is foldably joined to the bottom edge of side wall 12 along fold line 22 and is provided with medial fold line 23.

Handle structure for the carrier includes handle panels 24 and 25 which are foldably joined respectively to medial panels 9 and 19 along fold lines 11 and 20. In order to provide additional strength in the area of the handle, reinforcing panels 26 and 27 are provided and are joined respectively to handle panels 24 and 25 along fold lines 28 and 29. Also auxiliary flap 30 is foldably joined to handle panel 25 along fold line 29. Hand gripping apertures 31 and 32 are formed respectively in handle panels 24 and 25 and, similarly, hand gripping apertures 33 and 34 are formed respectively in reinforcing panels 26 and 27.

To provide medial article separation, medial partition structure, at one end of the blank, comprises medial panels 8 and 17 together with medial partition panel 35 which is foldably joined to medial panel 17 along fold line 36. Likewise at the right hand end of the blank, as viewed in FIG. 2, the medial partition structure comprises medial panels 9 and 19 and medial partition panel 37 which is foldably joined to medial panel 19 along fold line 38.

In order to provide individual article receiving cells, transverse partition structure is provided and includes transverse partition panels 39, 40, 41, and 42. Transverse partition panel 39 is foldably joined along fold lines 43 and 44 to medial panel 8 and, similarly, transverse partition panel 40 is foldably joined to medial panel 17 along fold lines 45 and 46. Also transverse partition panel 41 is foldably joined to medial panel 19 along fold lines 47 and 48 and transverse partition panel 42 is foldably joined to medial panel 9 along fold lines 49 and 50.

Additional transverse partition structure is provided in the form of transverse partition panels 51, 52, 53, and 54 which are foldably joined respectively to transverse partition panels 39, 40, 41, and 42 along fold lines 55, 56, 57, and 58. According to this invention, the distance between fold lines 55 and 56 and the adjacent end of the blank is less than the distance between fold lines 57 and 58 and the associated end of the blank. Of course this feature effects a saving of paperboard material.

In addition anchoring tab 59 is foldably joined to transverse partition panel 51 along fold lines 60 and 61 and, likewise, anchoring tab 62 is foldably joined to transverse partition panel 52 along fold lines 63 and 64. Similarly anchoring tab 65 is foldably joined to transverse partition panel 53 along fold lines 66 and 67 and, likewise, anchoring tab 68 is foldably joined to transverse partition panel 54 along fold lines 69 and 70.

In order to form the completed carrier from the blank shown in FIG. 2, an application of glue is first made to the inner surfaces of handle panels 24 and 25 and to reinforcing panels 26 and 27 as shown by stippling in FIG. 2. Thereafter reinforcing panels 26 and 27 are elevated and folded over to the right along their respective fold lines 28 and 29 into positions of flat face contacting relation with the inner surfaces of handle panels 24 and 25 respectively.

Figure 3:
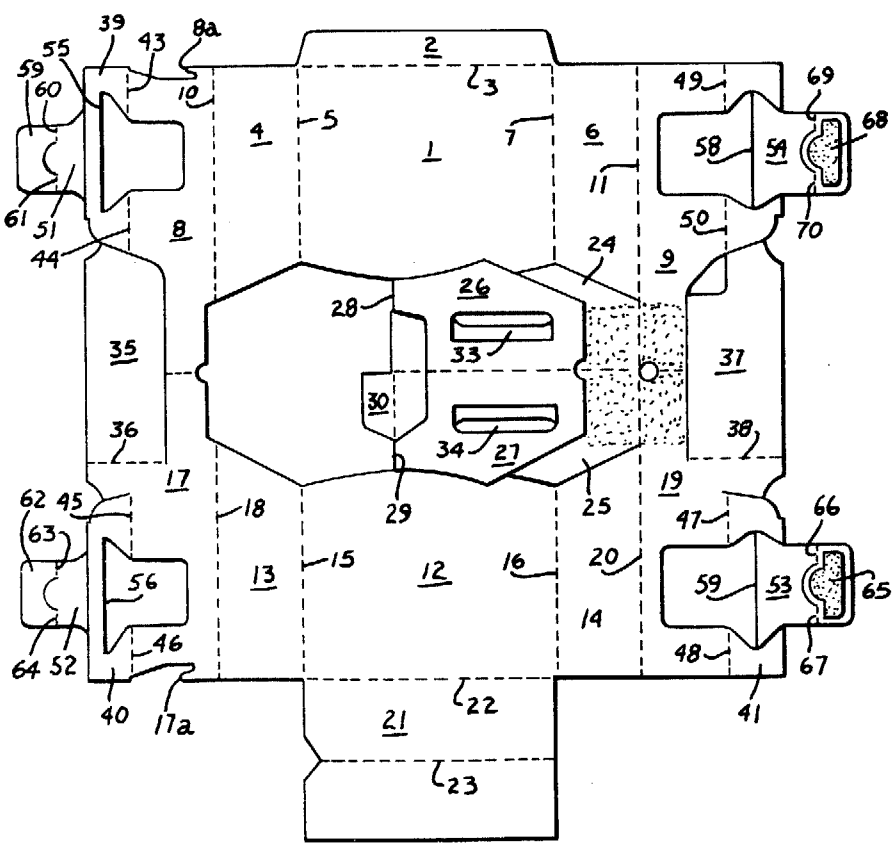

Following this, transverse partition panels 51 and 52 together with anchoring tabs 59 and 62 are folded downwardly out of the plane of the blank as viewed in FIG. 2 and rotated toward the left 180° along fold lines 55 and 56 respectively to occupy the positions shown in FIG. 3. Then an application of glue is made to transverse partition panels 41 and 42. Generally simultaneously with the folding of transverse partition panels 51 and 52, transverse partition panels 53 and 54 and their associated anchoring tabs 65 and 68 are folded upwardly 180° toward the right and out of the plane of the blank along fold lines 57 and 58 respectively. The inner surfaces of transverse partition panels 53 and 54 are then adhered respectively to the inner surfaces of transverse partition panels 41 and 42. The carrier then appears as shown in FIG. 3.

Following this operation an application of glue is made to anchoring tabs 65 and 68, handle panels 24 and 25, and medial panels 9 and 19 as indicated by stippling in FIG. 3. Then the transverse partition structure on the right hand side of the blank as viewed in FIG. 3 together with the medial partition structure comprising medial panels 9 and 19 medial partition panel 37 are elevated and folded toward the left along fold lines 11 and 20. By this operation anchoring tabs 65 and 68 are adhered to the inner surfaces of side walls 12 and 1 respectively as shown in FIG. 4.

Figure 4:
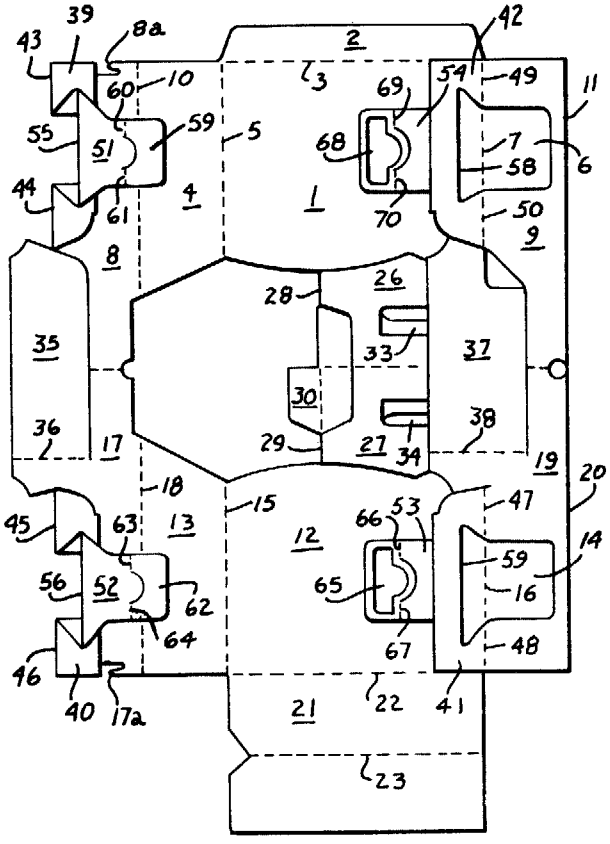
FIGS. 3, 4, 5, 6 and 7 depict intermediate stages through which the blank of FIG. 2 is manipulated and glued in order to form a complete and collapsed carrier as shown in FIG. 8.
Figure 6:
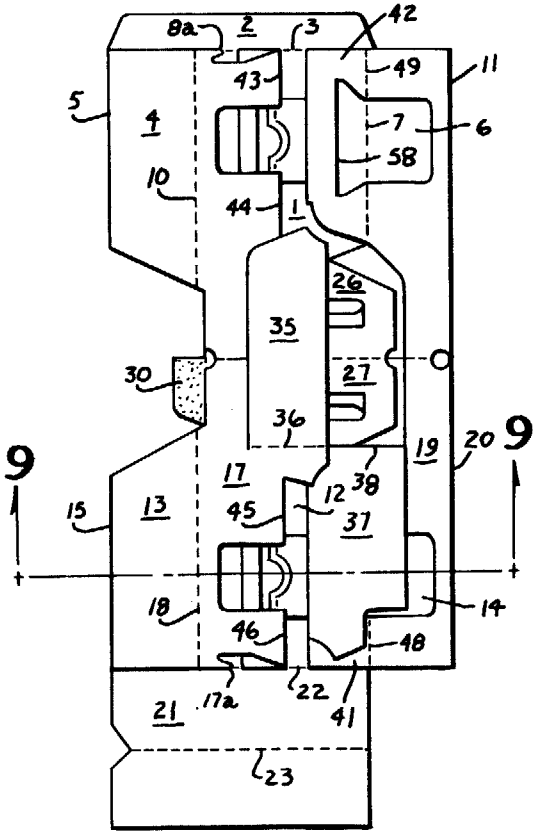
Figure 5:
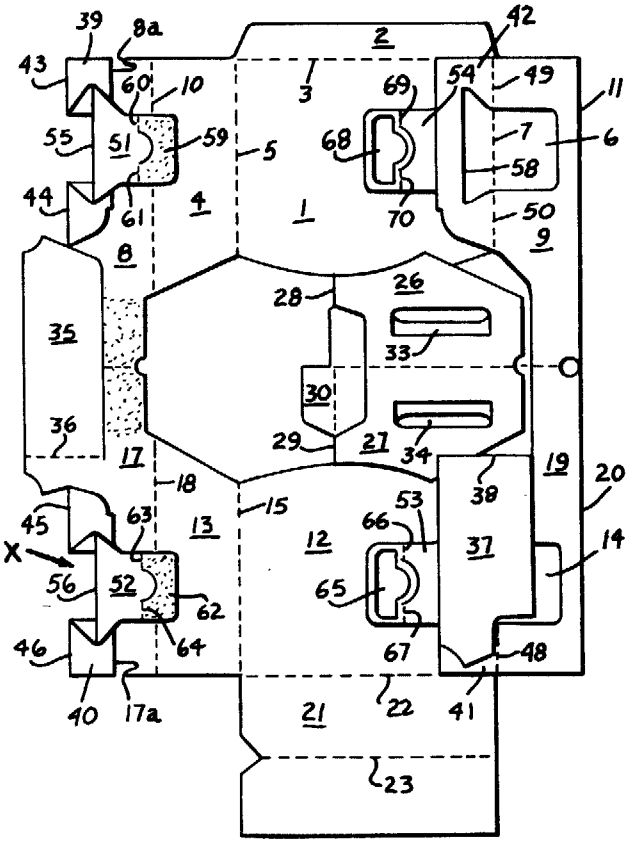

In addition the transverse partition structure disposed on the left hand side of the blank as viewed in FIG. 3 together with the associated anchoring tabs are folded over to the right along fold lines 43, 44, 45, and 46 into the positions depicted in FIG. 4. Then medial partition panel 37 is folded up and downwardly along fold line 38 to occupy the position shown in FIG. 5. An application of glue is then made to medial panels 8 and 17 and achoring tabs 59 and 62 as shown by stippling in FIG. 5. Thereafter end wall panels 4 and 13, medial panels 8 and 17, medial partition panel 35 and the associated transverse partition structure on the left hand side of the blank as viewed in FIG. 5 are elevated and folded toward the right along fold lines 5 and 15 to occupy the positions shown in FIG. 6. By this operation anchoring tabs 59 and 62 are adhered to the inner surfaces of side walls 1 and 12 respectively. Also glue is applied to auxiliary tab 30 as indicated by stippling in FIG. 6 and the auxiliary tab 30 is folded over along fold line 29 and adhered to a portion of the inner surface of medial panel 17. Then medial partition panel 35 is elevated and folded downwardly along fold line 36 to occupy the position shown in FIG. 7.

Figure 9:
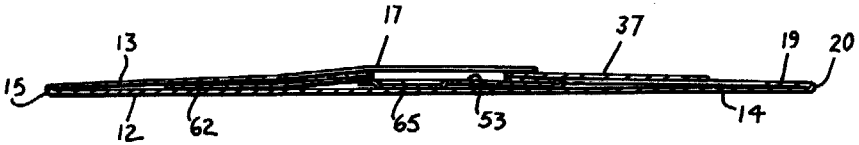
FIG. 9 is an enlarged view taken along the line 9—9 in FIG. 6.

Since transverse partition panel 52 is folded over into face contacting relation with transverse partition panel 40 which in turn is folded into face contacting relation with medial panel 17, an area void of paperboard material results as indicated by the letter "X" in FIG. 5 and as shown in FIG. 9. When transverse partition panels 40 and 52 and medial panel 17 are folded over to the right, anchoring tab 65 would normally be completely disposed in this void. Therefore the compression necessary for proper glueing of anchoring tab 65 is lacking.

According to this invention anchoring tab 65 is enlarged an amount sufficient to allow transverse partition structure in the form of transverse partition panels 40 and 52 to overlap anchoring tab 65. Thus proper compression is achieved as the carrier is formed during the folding and glueing operations. In addition, according to this invention, the glue surface of anchoring tab 65 is embossed which acts to facilitate adhesion to the interior surface of side wall 12. Of course these features also apply to corresponding transverse partition panels 39 and 51, medial panel 8, and anchoring tab 68 disposed on the opposite side of the blank.

Figure 7:
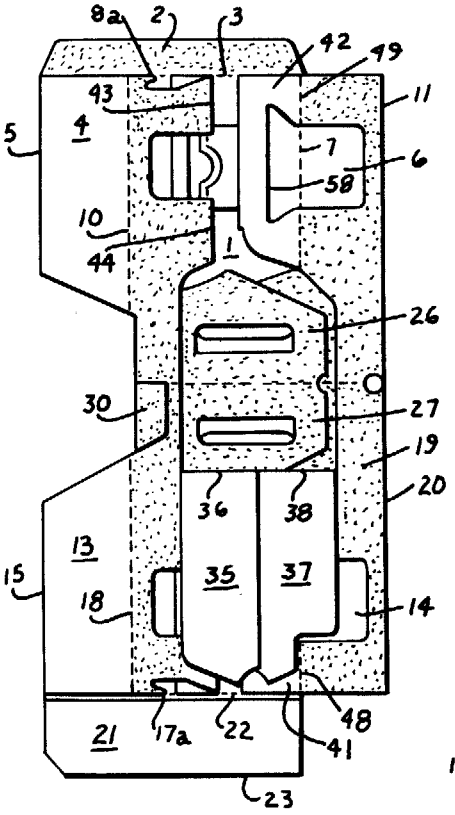

To complete the carrier, an application of glue is made thereto as shown by stippling in FIG. 7. More specifically glue is applied to medial panels 8, 9, 17, and 19, reinforcing panels 26 and 27, auxiliary panel 30, and glue flap 2. Bottom wall 21 is then folded along fold line 23. Following this the upper portion of the blank, as viewed in FIG. 7, is elevated and folded into the position depicted in FIG. 8. The carrier then appears as shown in FIG. 8 which represents the completed carrier in collapsed condition.

Figure 1:
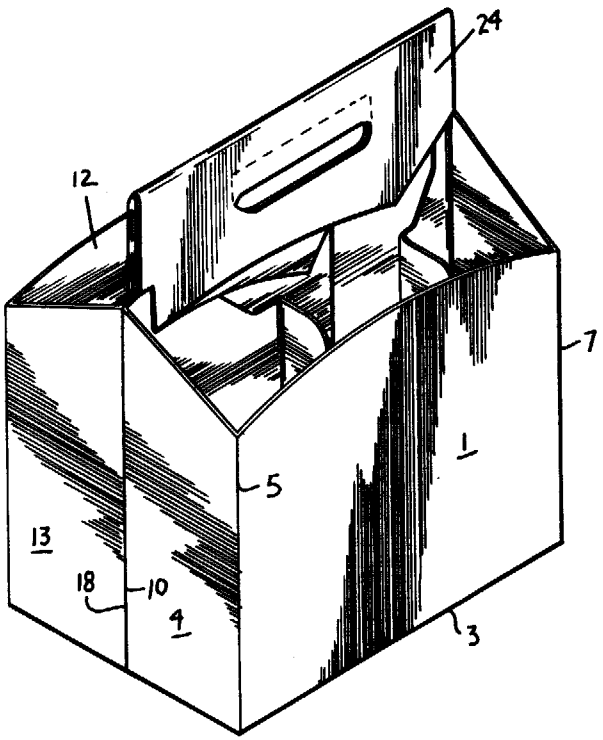
FIG. 1 is an isometric view of set-up carrier formed according to this invention.
Figure 8:
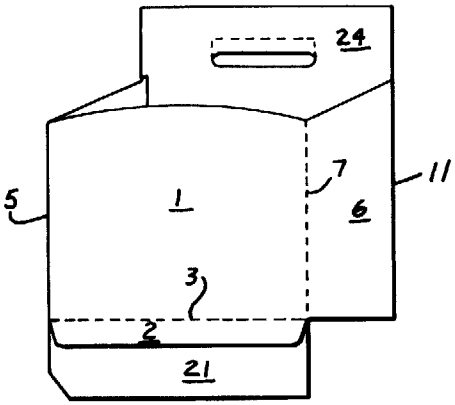

In order to set up the carrier from its collapsed condition as shown in FIG. 8 into the condition shown in FIG. 1, it is simply necessary to secure the side walls 1 and 12 against movement toward the left and to apply a force toward the left to the medial edges of end wall panels 6 and 14. This expands the carrier and moves the side walls apart. Simultaneously the bottom wall 21 folds into a flat plane. The carrier is maintained in set-up condition by cooperation between the locking notches **8*a* and 17*a* and one end of bottom wall 21**. The carrier then appears as shown in FIG. 1.

INDUSTRIAL APPLICABILITY

By this invention an article carrier is provided which has double thickness medial and transverse partitions at all critical points of article contact and is particularly well adapted for convenient and secure glueing during the manufacturing process.

I claim:

1. A collapsed article carrier comprising handle structure (24,25), medial partition structure (8,9,17,19) extending downwardly from said handle structure, a first pair of end wall panels (6,14) foldably joined to one end of said medial partition structure and disposed in overlapping relation therewith, a pair of side walls (1,12) foldably joined respectively to said first pair of end wall panels and being coplanar therewith, a second pair of end wall panels (4,13) foldably joined respectively to said pair of side walls remote from said first pair of end wall panels and disposed in overlapping relation therewith and being foldably joined to said medial partition structure along the edges remote from said pair of side walls, a bottom wall (21) folded in half and secured along the side edges thereof respectively to the lower edges of said pair of side walls, a first pair of transverse partition panels (39,40,41,42) foldably joined to said medial partition structure on one side of the carrier, a second pair of transverse partition panels (51,52,53,54) foldably joined respectively to said first pair of transverse partition panels and disposed in overlapping relation therewith, a pair of anchoring tabs (59,62,65,68) foldably joined respectively to said second pair of transverse partition panels and secured to the associated one of said side walls, and characterized in that one of said second pair of transverse partition panels is disposed in overlapping relation with the one of said anchoring tabs foldably joined to the other of said second pair of transverse partition panels.

2. A collapsed article carrier according to claim 1 and further characterized in that a first medial partition panel (35) is foldably joined along the upper edge thereof to said medial partition structure.

3. A collapsed article carrier according to claim 2 and further characterized in that a second medial partition panel (37) is foldably joined along the upper edge thereof said medial partition structure and is disposed in overlapping relation with said first medial partition panel.

4. A collapsed article carrier according to claim 1 and further characterized in that said one anchoring tab (65,68) is wider than the other of said anchoring tabs.

5. A collapsed article carrier according to claim 4 and further characterized in that the surface of said one anchoring tab is embossed.

6. A collapsed article carrier according to claim 1 and further characterized in that the distance between the outer edge of one of said first pair of transverse partition panels and the inner edge of the corresponding one of said second pair of transverse partition panels is less than the distance between the outer edge of the other of said first pair of transverse partition and the inner edge of the corresponding one of said second pair of transverse partition panels.

7. An article carrier comprising a bottom wall (21), a pair of side walls (1,12) foldably joined to the side edges of said bottom wall, end wall panels (4,6,13,14) foldably joined respectively to the end edges of said side walls and extending inwardly therefrom, medial partition structure (8,9,17,19) foldably joined to the inner edges of said end wall panels and extending medially inward of the carrier, handle structure (24,25) secured to said medial partition structure and extending upwardly therefrom, a first pair of transverse partition panels (39,40,41,42) foldably joined to the medial partition structure on each side of the carrier, a second pair of transverse partition panels (51,52,53,54) foldably joined respectively to said first pair of transverse partition panels on each side of the carrier and disposed in overlapping relation therewith, an anchoring tab (59,62,65,68) foldably joined to each of said second pair of transverse partiton panels and secured to the inner surface of the associated side wall, and characterized in that the distance between the outer edge of one of said first pair of transverse partition panels on each side of the carrier and the associated side wall is greater than the distance between the outer edge of the other of said first pair of transverse partition panels on each side of the carrier and the associated side wall.

8. An article carrier according to claim 7 and further characterized in that one of said anchoring tabs on each side of the carrier is larger than the corresponding anchoring tab.

9. An article carrier blank comprising a bottom wall (21), a first side wall (12) foldably joined to a side edge of said bottom wall, a first pair of end wall panels (13,14) foldably joined respectively to the end edges of said first side wall, a first pair of medial panels (17,19) foldably joined respectively to the edges of said first pair of end wall panels remote from said first side wall, a second pair of medial panels (8,9) foldably joined respectively to said first pair of medial panels, a second pair of end wall panels (4,6) foldably joined respectively to said second pair of medial panels, a second side wall (1) foldably joined to said second pair of end wall panels remote from said second pair of medial panels, a first pair of transverse partition panels (39,40,41,42) foldably joined respectively to one of said pairs of medial panels remote from the end wall panels, and characterized in that one of said transverse partition panels is narrower than the other of said transverse partition panels.

10. An article carrier blank according to claim 9 and comprising a second pair of transverse partition panels (51,52,53,54) foldably joined respectively to said first pair of transverse partition panels, a pair of anchoring tabs (56,62,65,68) foldably joined respectively to said second pair of transverse partition panels, and further characterized in that one of said anchoring tabs is larger than the other of said anchoring tabs.

* * * * *